US006460282B1

(12) United States Patent
Bustos

(10) Patent No.: US 6,460,282 B1
(45) Date of Patent: Oct. 8, 2002

(54) HAMMER MECHANISM FOR FIREARMS

(76) Inventor: Alfredo A. Bustos, Chile 428(E), Monoblock 7-Dpto. "E", San Juan (AR), 5400

( * ) Notice: Subject to any disclaimer, the term of this patent is extended or adjusted under 35 U.S.C. 154(b) by 0 days.

(21) Appl. No.: 09/042,863

(22) Filed: Mar. 17, 1998

(51) Int. Cl.[7] ..... F41A 17/00
(52) U.S. Cl. ..... 42/66; 42/70.01; 42/70.08
(58) Field of Search ..... 42/66, 70.08, 65, 42/41, 70.01

(56) References Cited

U.S. PATENT DOCUMENTS

| | | | | | |
|---|---|---|---|---|---|
| 3,209,480 | A | * | 10/1965 | Mittlesteadt | 42/70.08 |
| 3,748,771 | A | * | 7/1973 | Piscetta | 42/66 |
| 4,016,668 | A | * | 4/1977 | Frazier | 42/69 |
| 4,023,296 | A | | 5/1977 | Frisoli | 42/69 |
| 4,170,837 | A | | 10/1979 | Smith | 42/65 |
| 4,391,057 | A | * | 7/1983 | Bornancini | 42/65 |
| 4,615,133 | A | * | 10/1986 | Center | 42/70.08 |
| 4,819,358 | A | | 4/1989 | Eder | 42/65 |
| 5,052,141 | A | | 10/1991 | Sammons | 42/69 |
| 5,335,437 | A | | 8/1994 | Andersen | 42/70.08 |
| 5,651,205 | A | * | 7/1997 | Ruger et al. | 42/70.08 |
| 5,910,003 | A | * | 6/1999 | Kleinpaul | 42/70.11 |

* cited by examiner

*Primary Examiner*—David M. Mitchell
*Assistant Examiner*—Denise J Buckley
(74) *Attorney, Agent, or Firm*—Kenneth A. Keeling; Jaime A. Castano

(57) ABSTRACT

My invention is a new and improved hammer mechanism which reduces the strength of the hammer mainspring without also reducing the hammer's strike force. My invention comprises a link mechanism integrally assembled to the hammer of a firearm. The link mechanism moves at a positive velocity relative to the hammer as the hammer itself moves from the "cocked" position to the striking position. Both the hammer and the link mechanism are biased into the striking position by the hammer mainspring with a section of the link mechanism protruding from the front surface of the hammer and impacting the firing element of the firearm or primer. The link mechanism thus impacts the firing element or primer at a velocity and force roughly equal to the aggregate velocities and forces of the hammer and the link mechanism. In the preferred embodiment, the link mechanism comprises a first and second cavities within the hammer, each cavity having a plunger slidingly disposed therein and each plunger biased within its corresponding cavity by a spring. As the hammer mainspring biases the hammer into the striking position, it also concurrently biases the two sets of plungers and springs within the cavities thereby enabling a section of one of the two plungers to protrude from the hammer front surface and impact the firing element or primer. The invention may be installed as a substitute for and improvement over prior art hammer mechanisms.

19 Claims, 3 Drawing Sheets

HAMMER MECHANISM FOR FIREARMS

BACKGROUND OF THE INVENTION

1. Field of Invention

This invention relates generally to firearms. Specifically, this invention is a new and improved hammer mechanism which maintains or increases the firing strike force of the hammer while including a mainspring which requires less strength than comparable factory-installed springs. The invention may be installed as a substitute for and improvement over prior art hammer mechanisms.

As is evident to a person with ordinary skill in the art, a variety of reasons exist to reduce the strength of the hammer mainspring in a firearm. For instance, in a double-action firearm, the hammer mainspring strength may be reduced in order to reduce the trigger force necessary to actuate the hammer and shoot a bullet out of the firearm. Reducing the necessary trigger force in turn decreases the chances of the user deviating from his line of aim and shooting an inaccurate shot. It is noted that such trigger force reduction takes place without alteration of the trigger return spring, which returns the trigger to its "initial" position after firing.

However, the reduction of hammer mainspring strength may also create additional problems. For instance, if the strength of the hammer mainspring is reduced, then such spring may be unable to generate the strike force necessary to activate the primer of the cartridge.

It would thus be beneficial to the field of art to provide a new and improved hammer mechanism which reduces the trigger force of a double-action firearm while not compromising either the hammer strike force or the ability of the trigger return spring to bias the trigger back to its initial position.

It would also be beneficial to the field of art to provide a new and improved hammer mechanism which safely reduces the amount of force required to actuate the hammer and shoot a bullet out of a firearm.

It would also be beneficial to the field of art to provide a new and improved hammer mechanism which includes a hammer mainspring with less strength than comparable factory-installed mainsprings while not compromising the strike force of the hammer.

In general, firearms may be divided into handguns and rifles. Some rifles and most types of handguns utilize a hammer and trigger mechanism, and each can be categorized as a single-action firearm or a double-action firearm. Handgun types utilizing a hammer and trigger mechanism may be divided into pistols, revolvers, single-shot firearms, semi-automatic firearms, and fully-automatic firearms. Each type of handgun and each rifle utilizing a hammer and trigger mechanism contains different internal mechanisms governing its operation.

It would thus be beneficial to the field of art to provide a new and improved hammer mechanism which may be used by and installed in all firearms utilizing a hammer and trigger mechanism despite their differences in internal mechanisms and trigger forces. As will be briefly explained herein, the benefits of my invention for each firearm type differ depending on the firearm type.

2. Related Art

Different hammer mechanisms, some of which reduce the actuating trigger force of a firearm, are known to the prior art. Illustrative of such methods and mechanisms are U.S. Pat. No. 4,023,296 issued to Frisoli on May 17, 1977; U.S. Pat. No. 4,819,358 issued to Eder on Apr. 11, 1989; and U.S. Pat. No. 5,052,141 issued to Sammons on Oct. 1, 1991.

The present invention is different than such methods and mechanisms in both its structure and its method of function and operation.

SUMMARY OF THE INVENTION

Accordingly, the objectives of this invention are to provide, inter alia, a new and improved hammer mechanism that:

- includes a hammer mainspring with less strength than comparable factory-installed mainsprings while not compromising the strike force of the hammer;
- reduces the trigger force of a double-action firearm while not compromising the strike force of the hammer;
- reduces the trigger force of a double-action firearm while not compromising the ability of the trigger return spring to bias the trigger back to its initial position;
- safely reduces the amount of force required to actuate the hammer and shoot a bullet out of a double-action firearm; and
- may be used by and installed in all firearms utilizing a hammer and trigger mechanism despite their differences in internal mechanisms and trigger forces.

Other objects of the invention will become apparent from time to time throughout the specification hereinafter disclosed.

To achieve such improvements, my invention is a new and improved hammer mechanism which reduces the strength of the hammer mainspring without also reducing the hammer's strike force. My invention comprises a link mechanism integrally assembled to the hammer of a firearm The link mechanism moves at a positive velocity relative to the hammer as the hammer itself moves from the "cocked" position to the striking position. Both the hammer and the link mechanism are biased into the striking position by the hammer mainspring with a section of the link mechanism protruding from the front surface of the hammer and impacting the firing element of the firearm or primer. The link mechanism thus impacts the firing element or primer at a velocity and force roughly equal to the aggregate velocities and forces of the hammer and the link mechanism. In the preferred embodiment, the link mechanism comprises a first and second cavities within the hammer, each cavity having a plunger slidingly disposed therein and each plunger biased within its corresponding cavity by a spring. As the hammer mainspring biases the hammer into the striking position, it also concurrently biases the two sets of plungers and springs within the cavities thereby enabling a section of one of the two plungers to protrude from the hammer front surface and impact the firing element or primer. The invention may be installed as a substitute for and improvement over prior art hammer mechanisms.

DETAILED DESCRIPTION OF THE INVENTION

Figure 1:
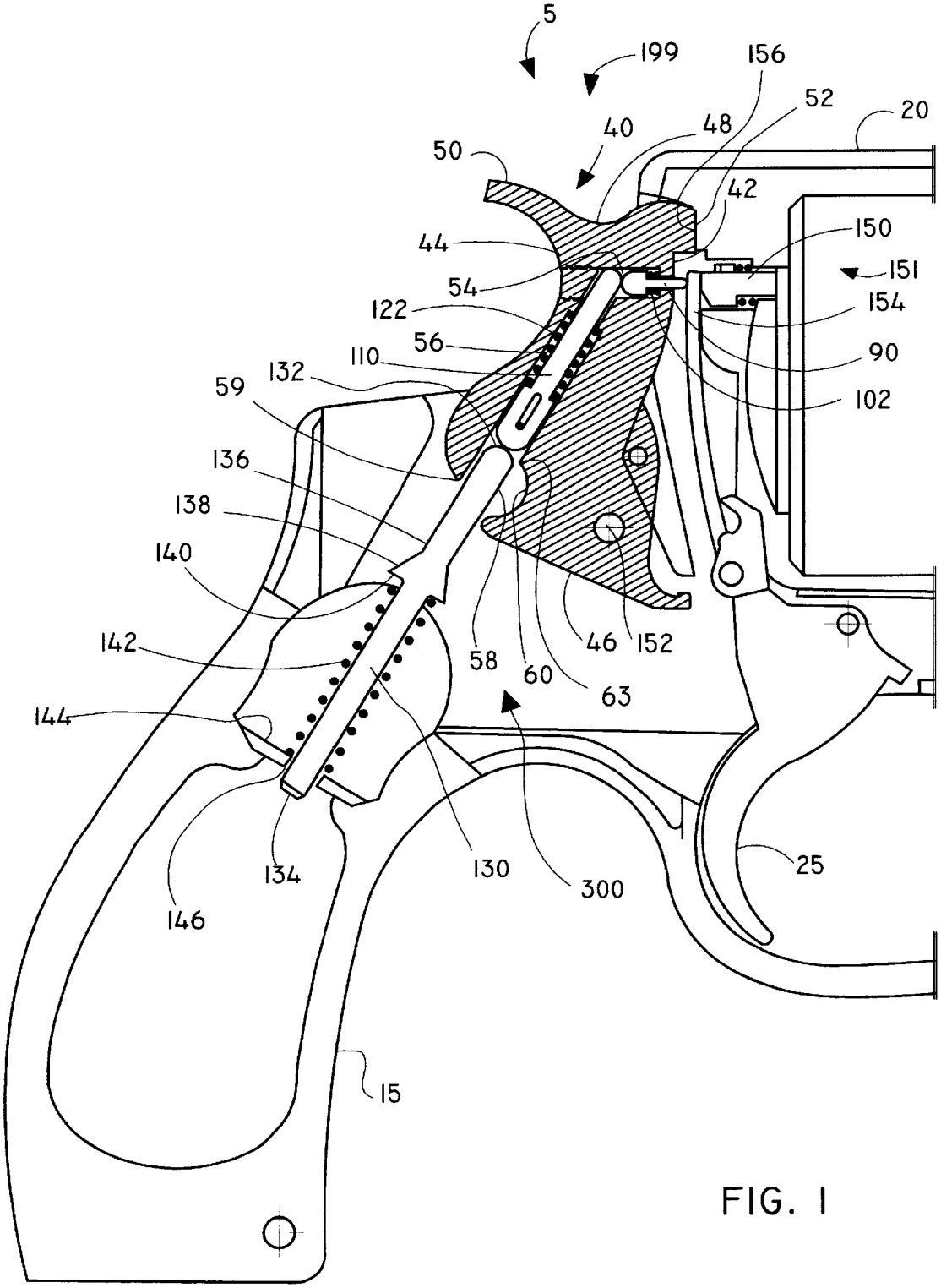
FIG. 1 is a cross-sectional view of a first position of the hammer mechanism within a firearm.
Figure 2:
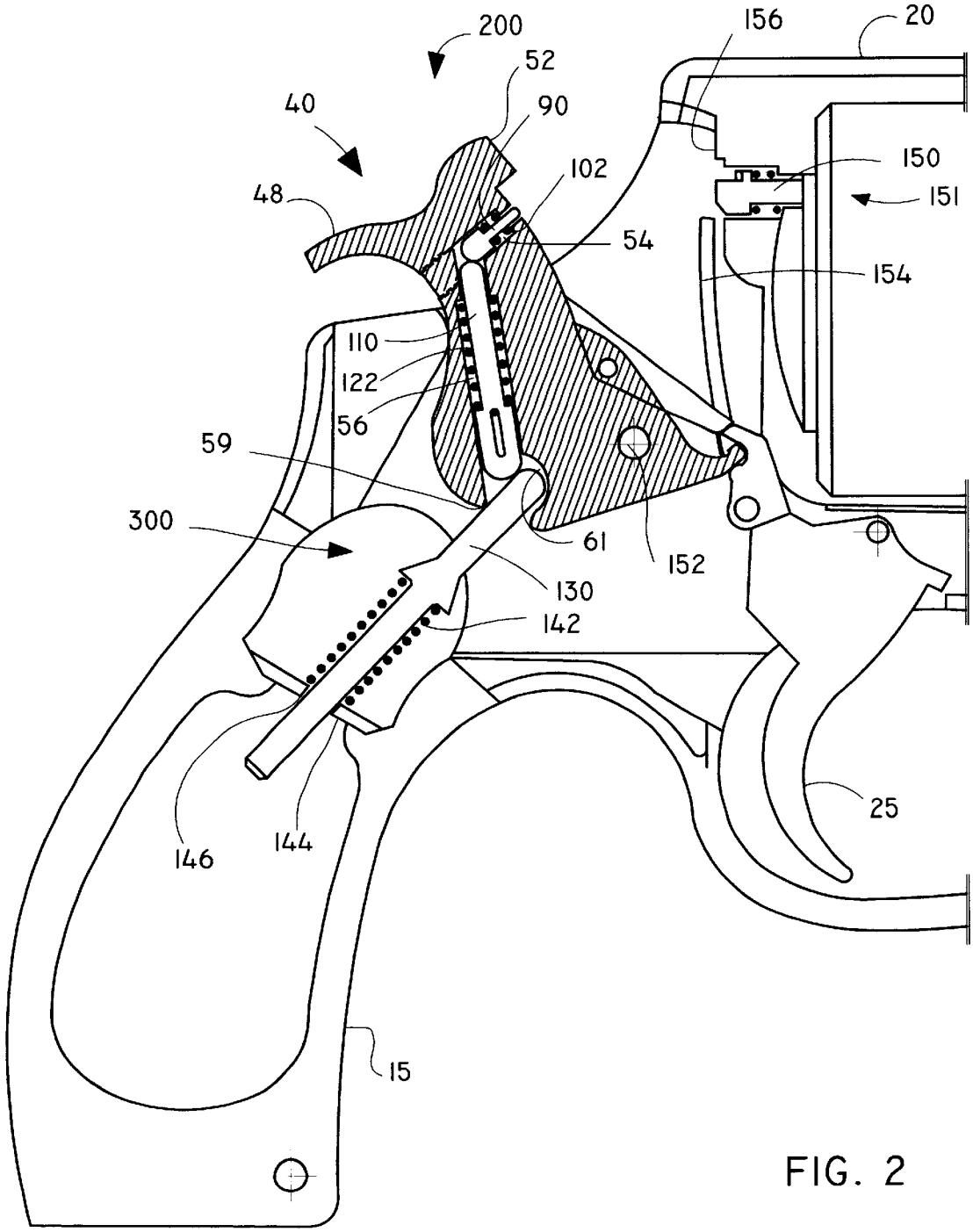
FIG. 2 is a cross-sectional view of a second position of the hammer mechanism within a firearm.

The new and improved hammer mechanism is shown generally in FIGS. 1–4 as reference numeral 5. In FIGS. 1 and 2, hammer mechanism 5 is shown assembled within a firearm 10. Although the firearm depicted in the Figures is clearly a revolver, it is understood that hammer mechanism 5 may be used in any firearm which utilizes a hammer and trigger mechanism, including rifles, semi-automatic pistols, revolvers, single-shot handguns, single-action firearms, and double-action firearms. The revolver of the Figures is shown for purposes of illustration only.

It is also understood that although hammer mechanism 5 may be used in any firearm which utilizes a hammer and trigger mechanism, the results and benefits of hammer mechanism 5, particularly those due to the inclusion of its "weaker" mainspring, differ depending on the type of firearm.

For instance, the utilization of a weaker hammer mainspring in double-action firearms, including double-action pistols and double-action revolvers, results in the firearm having a reduced trigger force. The benefits of a reduced trigger force have been previously explained.

Furthermore, since the weaker hammer mainspring provides less resistance to the return slide spring in pistols, the utilization of a weaker hammer mainspring in single- and double-action pistols results in the firearm having a faster slide job (ie. the slide travels back faster after shots). A faster slide job will in turn necessitate the use of a stronger return slide spring in order to absorb the shock against the gun frame caused by the firing of a bullet. A stronger return slide spring causes the slide to be biased forward to the firing position at a faster rate thereby assuring that each round is carried into the firing chamber with a swifter and stronger motion. Such a swifter and stronger motion is particularly beneficial when the magazine spring is itself very powerful or when the magazine is fully loaded.

Firearm 10 includes a grip 15, a frame 20, a trigger 25, and a hammer 40. Hammer mechanism 5 generally comprises hammer 40, a first plunger 90, a second plunger 110, and a main plunger 130. Each plunger is at least partially slidably disposed within hammer 40, and each plunger is biased in its corresponding position by a spring. The plungers, 90, 110, and 130, and their corresponding springs comprise a link mechanism 300.

For purposes of clarity and brevity, the firearm frame 20 will generally be referred to as the "front" of the firearm 10 while the firearm grip 15 will generally be referred to as the "rear" of the firearm 10. Subsequent designations of parts herein utilizing either the term "rear" or "front" will be relative to such definitions.

In general terms, my invention achieves the benefits and results listed above by including a hammer mainspring requiring significantly less strength than the hammer mainsprings of prior art firearms. However, due to the internal structure of the hammer mechanism 5, the reduction in hammer mainspring strength does not in turn result in a reduction in hammer strike force. Thus, in double-action firearms for example, hammer mechanism 5 allows for a decrease in trigger force while maintaining the required hammer strike force. And, since the entirety of my design concept is essentially located within the interior of a hammer, my invention may be used by any firearm which includes a hammer and trigger mechanism.

Hammer 40 comprises the typical hammer of a firearm 10, having the general and well-known hammer shape. Although a person knowledgeable in the field will recognize that not all hammers are shaped alike, such differences are inconsequential to the operation of my invention.

Hammer 40 includes a hammer front surface 42, a hammer rear surface 44, a hammer bottom surface 46, a hammer top surface 48, and two hammer side surfaces 47. As is clear from the Figures, hammer front surface 42 includes the forward surface 52 of the hammer 40 which typically strikes frame 20, and hammer rear surface 44 includes the hammer spur 50 of the hammer 40. Hammer 40 is preferably constructed from a lightweight high-strength material, such as titanium.

Generally, hammer mechanism 5 pivots about a pivot point 152 between two positions: a first position 199 and a second position 200. In first position 199 as shown in FIG. 1, hammer 40 is pivoted frontwards so that hammer forward surface 52 abuts frame receiving surface 156 and so that hammer front surface 42 is proximate firing element 151. Also generally, in second position 200 as shown in FIG. 2, hammer 40 is pivoted backwards so that a space separates hammer forward surface 52 and frame receiving surface 156 and so that hammer front surface 42 is distal firing element 151.

Firing element 151 comprises different embodiments depending on the model and type of firearm 10. For instance, some firearms 10 include only a firing pin 150 and others provide for the direct impact of the hammer and the primer of a cartridge (not shown). Furthermore, some firearms 10 include a firing safety mechanism, such as a transfer bar 154. It is understood that the hammer mechanism 5 of the present invention functions with all such firing elements 151.

Figure 3:
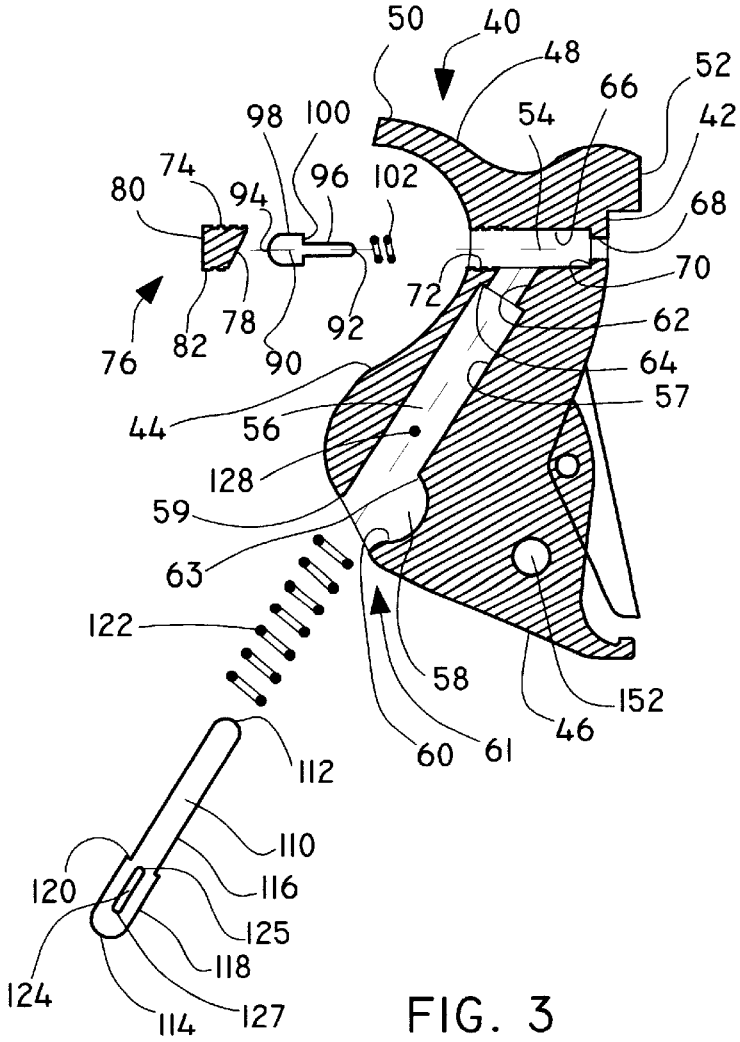
FIG. 3 is an exploded partial cross-sectional view of the hammer mechanism, not including the main plunger and associated structures.
Figure 4:
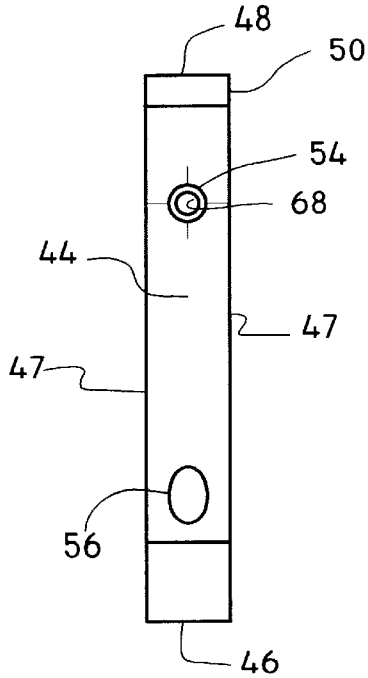
FIG. 4 is a rear elevational view of the hammer mechanism, without plungers or springs disposed therein.

As best seen in FIGS. 3 and 4, hammer 40 includes a first cavity 54 and a second cavity 56. First cavity 54 extends from hammer rear surface 44 towards and through hammer front surface 42. Second cavity 56 extends from hammer bottom surface 46 towards hammer top surface 48 and through first cavity 54. Second cavity 56 does not extend past but is in direct communication with first cavity 54. First and second cavities, 54 and 56, are each intermediate and do not extend through either hammer side surface 47. First and second cavities, 54 and 56, have a circular cross-sectional area.

First cavity 54 includes an inner surface 66. Adjacent hammer front surface 42, first cavity 54 also includes a first cavity reduced area section 68 which defines a first cavity lip 70. In the preferred embodiment, the reduction in area of first cavity 54 occurs at one cross-sectional area plane so that first cavity lip 70 is generally perpendicular to first cavity inner surface 66.

In addition, adjacent hammer rear surface 44, first cavity 54 includes threading 72 on first cavity inner surface 66. First cavity threading 72 selectively engages to matching threading 74 disposed on hammer cap 76. Hammer cap 76 is generally cylindrical in shape comprising a front surface 78, a rear surface 80, and an outer surface 82. Hammer cap threading 74 is disposed on hammer cap outer surface 821

Preferably, when hammer cap 76 is threadably engaged to first cavity threading 72, hammer cap rear surface 80 is flush with hammer rear surface 44. Also in the preferred embodiment, hammer cap front surface 78 is flush with second cavity 56. Specifically, hammer cap front surface 78 is flush with the angle of direction of second cavity 56.

Second cavity 56 includes an inner surface 57. Adjacent hammer bottom surface 46 and proximate hammer front surface 42, second cavity 56 includes a cam means 61. In the preferred embodiment, cam means 61 comprises a notch 58 on hammer 40 which defines an arcuate surface 60. The junction between second cavity inner surface 57 and cam means 61 (or notch 58 in the preferred embodiment) which is distal hammer bottom surface 46 comprises the cam means front end 63.

Second cavity 56 also includes a second cavity pivot edge 59 which comprises the junction of second cavity 56 and hammer bottom surface 46 on the side of second cavity 56 opposite cam means 61. Adjacent first cavity 54, second cavity 56 also includes a second cavity reduced area section 62 which defines a second cavity lip 64. In the preferred embodiment, the reduction in area of second cavity 56 occurs at one cross-sectional area plane so that second cavity lip 64 is generally perpendicular to second cavity inner surface 57.

First plunger 90 is elongate in shape having a front end 92, a rear end 94, and a body 96. Preferably, first plunger 90 has a circular cross-sectional area. Also preferably, first plunger front end 92 and first plunger rear end 94 are generally spherical in shape. First plunger 90 also includes an enlarged area section 98 which defines a first plunger lip 100. In the preferred embodiment, the enlargement in area of first plunger 90 occurs at one cross-sectional area plane so that first plunger lip 100 is generally perpendicular to first plunger body 96. Also preferably, first plunger enlarged area section 98 is proximate first plunger rear end 94 and extends from first plunger lip 100 to first plunger rear end 94.

First plunger 90, and its corresponding parts, are sized and shaped so that first plunger enlarged area section 98 is slidably disposed within first cavity 54 thereby allowing first plunger front end 92 to be selectively extended through first cavity reduced area section 68.

First plunger 90 (and its sliding movement) is biased within first cavity 54 by first plunger spring 102. Preferably, first plunger spring 102 comprises a helical spring. First plunger spring 102 surrounds a portion of first plunger 90 and is disposed at one end against first plunger lip 100 and at its other end against first cavity lip 70.

In the preferred embodiment as shown in FIG. 2, when first plunger rear end 94 abuts hammer cap front surface 78, first plunger front end 92 is retracted within first cavity reduced area section 68. In this posture, no force is acting on first plunger rear end 94 and first plunger spring 102 is able to bias first plunger rear end 94 against hammer cap front surface 78. Also in this posture, first plunger spring 102 is compressed minimally, if at all.

Also in the preferred embodiment and as shown in FIG. 1, when a force acts against first plunger rear end 94 compressing first plunger spring 102, first plunger 90 slides within first cavity 54 in the direction of hammer front surface 42, and first plunger front end 92 extends out of first cavity reduced area section 68 thereby protruding from hammer front surface 42.

Second plunger 110 is elongate in shape having a front end 112, a rear end 114, and a body 116. Preferably, second plunger 110 has a circular cross-sectional area. Also preferably, second plunger front end 112 and second plunger rear end 114 are generally spherical in shape. Second plunger 110 also includes an enlarged area section 118 which defines a second plunger lip 120. In the preferred embodiment, the enlargement in area of second plunger 110 occurs at one cross-sectional area plane so that second plunger lip 120 is generally perpendicular to second plunger body 116. Also preferably, second plunger enlarged area section 118 is proximate second plunger rear end 114 and extends from second plunger lip 120 to second plunger rear end 114.

Second plunger 110, and its corresponding parts, are sized and shaped so that second plunger enlarged area section 118 is slidably disposed within second cavity 56 thereby allowing second plunger front end 112 to be selectively extended through second cavity reduced area section 62 and into first cavity 54.

Second plunger 110 further includes a slot 124, preferably on second plunger enlarged diameter section 118. Slot 124 extends from one side of second plunger body 116 towards and through the opposite side of second plunger body 116. Slot 124 includes a slot front end 125, which is proximate second plunger front end 112, and a slot rear end 127, which is proximate second plunger rear end 114.

Figure 5:
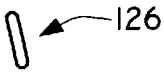
FIG. 5 is an elevational view of the hammer mechanism's cross-pin.

Working in tandem with slot 124, a cross pin 126, shown in FIG. 5, is selectively attached across second cavity 56 to second cavity inner surface 57, preferably on opposite sides. Each end of cross pin 126 is preferably selectively removably inserted within a cross pin hole 128, shown in FIG. 3, located on opposite sides of second cavity inner surface 57. Second plunger 110 is slidably disposed within second cavity 56 so that cross pin 126 extends through slot 124. Thus, cross pin 126 and slot 124 limit the sliding movement of second plunger 110 within second cavity 56.

Second plunger 110 (and its sliding movement) is biased within second cavity 56 by second plunger spring 122. Preferably, second plunger spring 122 comprises a helical spring. Second plunger spring 122 surrounds a portion of second plunger 110 and is disposed at one end against second plunger lip 120 and at its other end against second cavity lip 64.

In the preferred embodiment as shown in FIG. 2, when cross pin 126 abuts slot front end 125, a minimal force, if at all, acts against second plunger rear end 114, second plunger spring 122 is compressed minimally, if at all, and second plunger front end 112 is retracted within second cavity reduced area section 62 and does not protrude into first cavity 54. Furthermore, second plunger 110 must be sized so that, when cross pin 126 abuts slot front end 125, second plunger rear end 114 partially superposes or covers cam means 61 (or notch 58 and arcuate surface 60 in the preferred embodiment).

Also in the preferred embodiment and as shown in FIG. 1, when a force acts against second plunger rear end 114 compressing second plunger spring 122, second plunger 110 slides within second cavity 56 towards first cavity 54, and second plunger front end 112 extends out of second cavity reduced area section 62 and protrudes into first cavity 54. As previously disclosed, the compression of second plunger spring 122 is stopped when cross pin 126 abuts slot rear end 127, at which point [1] second plunger rear end 114 must be directly adjacent to the cam means front end 63 and [2] second plunger front end 112 protrudes well into first cavity 54.

Main plunger 130 is elongate in shape having a front end 132, a rear end 134, and a body 136. Preferably, main plunger 130 has a circular cross-sectional area. Also preferably, main plunger front end 132 is generally spherical in shape. Main plunger 130 also includes an enlarged area section 138 which defines a main plunger lip 140. In the preferred embodiment, the enlargement in area of main plunger 130 occurs at one cross-sectional area plane so that main plunger lip 140 is generally perpendicular to main plunger body 136. Also preferably, main plunger enlarged area section 138 is proximate main plunger front end 132 and extends from main plunger lip 140 to main plunger front end 132.

In order to accommodate main plunger 130, the interior of firearm grip 15 includes a neck 144. Neck 144 includes an opening 146 extending therethrough. Main plunger 130 is retained within firearm grip 15 so that main plunger front end 132 is proximate hammer 40 and so that main plunger rear end 134 is proximate neck 144.

Main plunger 130 (and its corresponding parts) and neck opening 146 are sized and shaped so that main plunger rear end 134 extends through neck opening 146 at all times. Furthermore, main plunger 130 is sized in-d shaped so that main plunger enlarged area section 138 is partially slidably disposed within second cavity 56 thereby allowing main plunger front end 132 to be selectively cammed along cam means 61. However, main plunger front end 132 should at no point extend within second cavity 56 past cam means front end 63 or outside of second cavity 56 external to hammer 40.

Main plunger 130 (and its sliding movement) is biased and maintained in its position by main plunger spring 142. Preferably, main plunger spring 142 comprises a helical spring. Main plunger spring 142 surrounds a portion of main plunger 130 and is disposed at on e end against main plunger lip 140 and at its other end against neck 144. Importantly, main plunger spring 142 must be stronger than and be able to overcome both first plunger spring 102 and second plunger spring 122.

A person with knowledge in the field will recognize that main plunger 130 and main plunger spring 142 generally correspond to the hammer mainspring and the hammer mainspring pin of prior art firearms. Importantly, for any firearm 10, main plunger spring 142 is less strong than the corresponding hammer mainspring normally utilized in that firearm (ie., the factory installed hammer mechanism). This reduction in strength enables the benefits and results which are an object of this invention.

In the preferred embodiment as shown in FIG. 1, when hammer mechanism is in the first position 199, main plunger 130 is generally axially aligned with second cavity 56, main plunger spring 142 is compressed minimally, if at all, and main plunger front end 132 is directly adjacent to the cam means front end 63. Also in the preferred embodiment and as shown in FIG. 2, when hammer 40 pivots about pivot point 152 into the second position 200, main plunger body 136 pivots about second cavity pivot edge 59, main plunger front end 132 cams along cam means 61 in the direction of hammer bottom surface 46, and main plunger spring 142 is thereby partially or further compressed.

IN OPERATION

Briefly, hammer mechanism 5 follows three steps during the firing sequence of firearm 10. In the initial first step, hammer mechanism 5 is in the first position 199, wherein hammer forward surface 52 abuts frame receiving surface 156 and hammer front surface 42 is proximate firing element 151. In the second step, hammer mechanism 5 is moved to the second position 200, wherein a space separates hammer forward surface 52 and frame receiving surface 156, and hammer front surface 42 is distal firing element 151. Lastly, in the main and third step, hammer mechanism 5 forcefully and rapidly reverts from the second position 200 back to the first position 199 whereby first plunger front end 92 impacts firing element 151 and whereby hammer forward surface 52 impacts frame receiving surface 156.

It is understood that each of the three steps listed is performed by all firearms which utilize a hammer and trigger mechanism (including all such pistols, revolvers, and rifles etc.). A person with ordinary skill in the art will understand, however, that the mechanisms and methods of activation of each step differ depending on the type of firearm. For instance, single-action revolvers require that the second step be performed manually. In other words, in single-action revolvers, the user must manually move or "cock" the hammer 40 from the first position 199 to the second position 200. A locking assembly, well-known in the prior-art and specific to each firearm model, then locks the hammer 40 in the second position until the activation of the trigger 25 allows the hammer 40 to forcefully and rapidly revert back to the first position 199. On the other hand, double-action firearms (revolvers and pistols) perform all three steps through the activation of the trigger 25.

Nevertheless, as will be explained herein, the essential mechanics of hammer mechanism 5 and internal link mechanism 300 are responsive to and dependent on the three listed steps; not on the different types of firearms. Thus, the internal mechanics of hammer mechanism 5 and internal link mechanism 300 are identical regardless of whether hammer mechanism 5 is used in a single-action firearm, a double-action firearm, a pistol, a revolver, or a rifle. The mechanics of the firearm 10 and the motion of the hammer mechanism 5 will therefore be described in relation to the three steps previously listed and not in relation to the particular structures of firearm types 10.

Importantly, even though the trigger force of a double-action firearm will be reduced by using hammer mechanism 5, such a result is not reached by modifying the trigger return spring of the firearm. Thus, the force exerted by the trigger return spring against the user's pull of the trigger will be considered constant and will be sufficient to return the trigger to its initial position after firing. In order to reduce the trigger force of a firearm, the present invention reduces the force exerted by the hammer mainspring or main plunger spring 142.

In the first step, hammer mechanism 5 is in the first position 199. It must be noted, however, that FIG. 1 illustrates the exact position of hammer mechanism 5 in step three. In step one, hammer mechanism 5 is positioned as shown in FIG. 1 except that transfer bar 154 is not situated intermediate firing pin 150 and first plunger 90. Thus, in the first step, for the firearm shown in the Figures, a space would exist between firing pin 150 and first plunger 90.

In the first step, hammer 40 is in the first position 199 with respect to pivot point 152, and main plunger 130 is axially aligned with second cavity 56. In this position, main plunger spring 142 is in its fully extended position (although it may be minimally compressed in this position).

Since main plunger spring 142 is stronger than and can overcome second plunger spring 122, main plunger front end 132, which abuts second plunger rear end 114, pushes second plunger 110 within second cavity 56 thereby compressing second plunger spring 122. As previously disclosed, the movement of second plunger 110 within second cavity 56 is limited by slot 124 and cross pin 126. Also as previously disclosed, at the point when cross pin 126 abuts slot rear end 127 thereby restricting any further movement of second plunger 110, second plunger rear end 114 abuts main plunger front end 132 at the cam means front end 63, and second plunger front end 112 protrudes well into first cavity 54 adjacent hammer cap front surface 78.

Since main plunger spring 142 is also stronger than and can overcome first plunger spring 102 and since second plunger front end 112 protrudes into first cavity 54 adjacent hammer cap front surface 78, second plunger front end 112, which abuts first plunger rear end 94, pushes first plunger 90 towards first cavity reduced diameter section 68. Thus, first plunger spring 102 is compressed against first cavity lip 70, and first plunger front end 92 protrudes from hammer front surface 42.

In the second step, hammer mechanism 5 is moved to the second position 200. As hammer 40 pivots backwards about pivot point 152, main plunger body 136 essentially pivots about second cavity pivot edge 59, and main plunger front end 132 cams along cam means 63 in the direction of hammer bottom surface 46 compressing main plunger spring 142. The space within second cavity 56 which was created by the camming and pivoting action of main plunger 130 allows the previously compressed second plunger spring 122 to concurrently bias second plunger 110 in the direction of hammer bottom surface 46 into that space. As previously disclosed, this motion continues until cross pin 126 abuts slot front end 125, at which point second plunger front end 112 no longer protrudes into first cavity 54 and second plunger rear end 114 partially superposes or covers cam means 63.

Due to the space within first cavity 54 which was created by the retraction of second plunger 110, previously compressed first plunger spring 102 its able to bias first plunger 90 within first cavity 54 towards hammer cap 76 so that first plunger rear end 94 abuts hammer cap front surface 78 and so that first plunger front end 92 no longer protrudes from hammer front surface 42.

In the third step, hammer 40 is forcefully and rapidly moved from its second position 200 to its first position 199 by the full depression of trigger 25 (in both single-action and double-action firearms) . The movement of hammer 40 from the second position 200 into first position 199 is caused by the sudden and rapid decompression of main plunger spring 142 which was compressed in the second step. As hammer 40 follows this motion, main plunger spring 142 is able to expand biasing main plunger front end 132 to cam along cam means 61 in the direction of hammer top surface 48, and main plunger body 136 is "forced" by arcuate surface 60 to once again essentially begin to pivot about second cavity pivot edge 59. Concurrently, since main plunger spring 142 is stronger than and can overcome second plunger spring 122, main plunger front end 132 pushes second plunger rear end 114 thereby compressing second plunger spring 122 causing second plunger front end 112 to protrude into first cavity 54. In turn, since main plunger spring 142 is also stronger than and can overcome first plunger spring 102, as second plunger front end 112 extends into first cavity 54, it pushes first plunger rear end 94 thereby compressing first plunger spring 102 and causing first plunger front end 92 to protrude from hammer front surface 42. Once and as it is protruding from hammer front surface 42, first plunger front end 92 then strikes firing element 151 causing a bullet to be shot from the firearm 10.

As previously disclosed, the motion of plungers, 90, 110, and 130, stops when the slot rear end 127 of second plunger 110 abuts cross pin 126. Preferably, the parts of hammer mechanism 5 are sized and calibrated so that such motion stops immediately after first plunger front end 92 impacts and strikes firing element 151. Also preferably, the parts of hammer mechanism 5 are sized and calibrated so that first plunger front end 92 protrudes from hammer front surface 42 and impacts firing element 151 at the end of the hammer's 40 movement into first position 199. At this point, hammer mechanism 5 is essentially back in the first position 199.

It is understood that the velocity and force at which the hammer 40 pivots from second position 200 to first position 199 is essentially provided and governed by main plunger spring 142. Thus, a reduction in main plunger spring 142 strength would usually lead to a reduction in-velocity and force of the hammer 40 motion. However, in the present invention, the hammer strike force and velocity is maintained at an adequate level (and is perhaps even increased in some cases) by the concurrent internal relative motion of the link mechanism 300 of the hammer 40, as disclosed below.

In the third step, as hammer 40 moves frontward from the second position 200 to the first position 199, it is noted that hammer 40 travels at one velocity and acceleration, the velocity given to it by the biasing of main plunger spring 142. Concurrently, due to the force exerted upon first plunger rear end 94 by the link mechanism 300 (ie., second plunger 110, second plunger spring 122, main plunger 130, and main plunger spring 142), first plunger 90 (specifically first plunger front end 92) travels frontward within first cavity 54 at a second velocity and acceleration.

It is imperative that the various parts of hammer mechanism 5, and specifically each element of link mechanism 300, including first plunger 90, first plunger spring 122, and cam means 63, be calibrated and sized so that first plunger front end 92 impacts firing element 151 as it is protruding from hammer front surface 42. In the preferred embodiment, the various parts of hammer mechanism 5, and specifically each element of link mechanism 300, including first plunger 90, first plunger spring 122, and cam means 63, are calibrated and sized so that when hammer forward surface 52 impacts frame receiving surface 156, first plunger front end 92 concurrently impacts firing element 151. Preferably, hammer forward surface 52 impacts frame receiving surface 156 at its maximum velocity and acceleration, and first plunger front end 92 impacts firing element 151 at its maximum velocity and acceleration. Such calibrations and sizing of the various parts of hammer mechanism 5 are determined by practice.

Relative to the essentially stationary firing element 151, first plunger front end 92 then travels at a velocity and acceleration roughly equal to the sum of the first plunger 90 velocity and acceleration and the hammer 40 velocity and acceleration. It is further noted that the velocity of first plunger 90 is positive relative to the velocity of hammer 40. Thus, first plunger front end 92 impacts transfer bar 154 with a velocity greater than the velocity of hammer 40 by itself or the velocity of first plunger 90 by itself. And since a greater velocity directly correlates to a greater force, first plunger front end 92 impacts transfer bar 154 with a force greater than the force of hammer 40 by itself or the force of first plunger 90 by itself.

By such mechanism, my invention is able to reduce the strength of the hammer mainspring (the main plunger spring 142) thereby also reducing the trigger force without compromising the hammer strike force necessary to properly activate the firing element 151.

As explained by the Applicant, the benefits of the invention may also be described in relation to the variable perpendicular distance between the main plunger 130 axis and pivot point 152 as the hammer mechanism 5 rapidly reverts from second position 200 back to first position 199. The torque (or angular acceleration) provided by hammer mainspring 142 to hammer 40 increases from second position 200 to first position 199 due to the camming action of main plunger first end 132 on cam means 61. At second position 200, when main plunger first end 132 has already cammed on cam means 61 in the direction of hammer bottom surface 46, the perpendicular distance between the axis of cammed main plunger 130 and pivot point 152 is less than the comparable measurement at first position 199, when main plunger 130 is axially aligned with second cavity 56. By well known principles and laws of physics, it then follows that the torque provided by hammer mainspring 142 to hammer 40 is greater at first position 199 since the perpendicular distance is largest at this position. Thus, hammer 40, and therefore first plunger front end 92, accelerate from second position 200 to first position 199. In addition, since the perpendicular distance is largest at first position 199, hammer 40, and therefore first plunger front end 92, achieve their highest acceleration immediately before reaching first position 199. This increase in torque and acceleration provided by the camming action of main plunger 130 allows for the strength reduction of main plunger spring 142 (hammer mainspring) thereby also reducing the trigger force without compromising the hammer strike force necessary to properly activate the firing element 151. It is noted by the inventor that such a benefit will also be provided solely by the camming action of main plunger 130 without the use of first plunger 90 and/or second plunger 110.

The foregoing disclosure and description of the invention is illustrative and explanatory thereof. Various changes in the details of the illustrated construction may be made within the scope of the appended claims without departing from the spirit of the invention. The present invention should only be limited by the following claims and their legal equivalents.

What is claimed is:

1. A new and improved hammer mechanism for activating a firing element of a firearm comprising:

a hammer including a hammer front surface;

said hammer pivoting about a pivot point between a first position and a second position;

said hammer front surface proximal said firing element in said first position;

said hammer front surface distal said firing element in said second position;

a link mechanism integrally connected to said hammer;

a main plunger and main plunger spring biasing said hammer from said second position to said first position; and said main plunger and main plunger spring concurrently and independently biasing said link mechanism so that a part of said link mechanism protrudes from said hammer front surface and impacts said firing element at a positive velocity relative to said hammer when said hammer is biased from said second position to said first position.

2. A mechanism as in claim 1, wherein said link mechanism is situated internally of said hammer.

3. A mechanism as in claim 2, wherein said link mechanism comprises:

said hammer having at least one cavity;

a plunger slidingly disposed within each of said at least one cavity;

a spring disposed within each of said at least one cavity biasing said corresponding plunger within said corresponding cavity;

said main plunger spring being stronger and able to overcome each of said at least one spring; and said main plunger and main plunger spring concurrently and independently biasing each of said at least one plunger and spring so that one of said at least one plunger protrudes from said hammer front surface and impacts said firing element at a positive velocity relative to said hammer when said hammer is biased from said second position to said first position.

4. A mechanism as in claim 3, wherein:

said at least one cavity comprises a first cavity and a second cavity;

said hammer further including a hammer rear surface, a hammer bottom surface, and a hammer top surface;

said first cavity extending from said hammer rear surface towards and through said hammer front surface;

a first plunger slidingly disposed within said first cavity;

a first plunger spring biasing said first plunger within said first cavity;

said second cavity extending from said hammer bottom surface towards said hammer top surface;

said second cavity being in direct communication with said first cavity;

a second plunger slidingly disposed within said second cavity;

a second plunger spring biasing said second plunger within said second cavity; and said main plunger and main plunger spring concurrently and independently biasing said first plunger and first plunger spring and said second plunger and second plunger spring so that a portion of said first plunger protrudes from said hammer front surface and impacts said firing element at a positive velocity relative to said hammer when said hammer is biased from said second position to said first position.

5. A mechanism as in claim 4, wherein:

said second cavity including a cam means located adjacent said hammer bottom surface and proximate said hammer front surface;

said main plunger having a main plunger front end proximate said hammer bottom surface and a main plunger axis;

said main plunger front end being slidingly disposed in said second cavity adjacent said hammer bottom surface;

said main plunger axis being axially aligned with said second cavity when said hammer is in said first position;

said main plunger axis being non-axially aligned with said second cavity when said hammer is in said second position;

wherein said main plunger front end cams along said cam means in the direction of said hammer top surface as said hammer moves from said second position to said first position thereby gradually bringing said main plunger into axial alignment with said second cavity.

6. A mechanism as in claim 5, wherein:

said cam means comprises a notch on said second cavity adjacent said hammer bottom surface and proximate said front surface; and said notch defining an arcuate surface on said second cavity.

7. A mechanism as in claim 6, wherein:

said junction of said second cavity and said hammer bottom surface opposite said cam means comprises a second cavity pivot edge;

said main plunger including a body;

said main plunger body essentially pivoting about said second cavity pivot edge as said main spring front end cams along said cam means in the direction of said hammer top surface.

8. A mechanism as in claim 7, wherein:

said first plunger including a front end proximate said hammer front surface;

said second plunger including a front end proximate said hammer top surface;

said main plunger front end pushing said second plunger in the direction of said first cavity as said main plunger front end cams along said cam means in the direction of said hammer top surface;

thereby causing said second plunger front end to protrude into said first cavity and push said first plunger in the direction of said hammer front surface so that said first plunger front end protrudes from said hammer front surface.

9. A mechanism as in claim 8, wherein:

said second plunger including a second plunger rear end proximate said hammer bottom surface;

said second plunger rear end abutting said main plunger front end;

said cam means having a cam means front end distal said hammer bottom surface ;

said second plunger being adjacent to said cam means front end when said hammer is in said first position; and said second plunger rear end partially superposing said cam means when said hammer is in said second position.

10. A mechanism as in claim 9, wherein:

said second plunger having a second plunger slot therethrough;

said second cavity including two cross pin holes located on opposite sides of said second plunger slot;

a cross pin selectively removably attached through said second plunger slot and within said second cavity cross pin holes;

said second plunger thereby being slidingly disposed on said cross pin;

said second plunger slot including a slot front end proximate said first cavity and a slot rear end proximate said hammer bottom surface;

said pin abutting said slot rear end when said hammer is in said first position; and said pin abutting said slot front end when said hammer is in said second position.

11. A mechanism as in claim 10; wherein:

said first cavity including a first cavity reduced area section adjacent said hammer front surface;

said first cavity reduced area section defining a first cavity lip within said first cavity;

said first plunger including an enlarged area section defining a first plunger lip; and said first plunger spring disposed between said first cavity lip and said first plunger lip.

12. A mechanism as in claim 11, wherein:

said second cavity including a second cavity reduced area section adjacent said first cavity;

said second cavity reduced area section defining a second cavity lip within said second cavity;

said second plunger including an enlarged area section defining a second plunger lip; and said second plunger spring disposed between said second cavity lip and said second plunger lip.

13. A mechanism as in claim 12, wherein:

said hammer including a hammer cap selectively removably attached within said first cavity adjacent said hammer rear surface;

said first plunger including a first plunger rear end proximate said hammer rear surface;

said first plunger rear end being distal to said hammer cap when said hammer is in said first position; and said first plunger rear end abutting said hammer cap when said hammer is in said second position.

14. A mechanism as in claim 13, wherein:

said hammer cap including a hammer cap front surface; and said hammer cap front surface being flush with said second cavity and with the angle of direction of said second cavity when said hammer cap is attached within said first cavity.

15. A mechanism as in claim 14, wherein:

said hammer cap having threading thereon;

said first cavity having matching threading thereon;

wherein said hammer cap threading cooperatively engages said matching first cavity threading to selectively, removably attach said hammer cap within said first cavity.

16. A mechanism as in claim 15, wherein:

said first plunger front end impacts said firing element as it protrudes from said hammer front surface.

17. A mechanism as in claim 15, wherein:

said first plunger front end impacts said firing element at its maximum velocity and acceleration.

18. A new and improved hammer mechanism for activating a firing element of a firearm, comprising:

a hammer including a hammer front surface;

said hammer pivoting about a pivot point between a first position and a second position;

said hammer front surface proximal said firing element in said first position;

said hammer front surface distal said firing element in said second position;

a main plunger and main plunger spring biasing said hammer from said second position to said first position;

at least one additional plunger integrally connected to said hammer; and said main plunger and main plunger spring concurrently and independently biasing said additional plunger so that a part of said additional plunger protrudes from said hammer front surface and impacts said firing element at a positive velocity relative to said hammer when said hammer is biased from said second position to said first position.

19. A mechanism as in claim 18, wherein said additional plunger is situated internally of said hammer.

* * * * *